United States Patent [19]

Taylor

[11] 4,364,201

[45] Dec. 21, 1982

[54] FULL-OPENING WINDOW LINKAGE ASSEMBLY

[75] Inventor: George A. Taylor, Los Angeles, Calif.

[73] Assignee: A. W. Anderberg Manufacturing Co., Los Angeles, Calif.

[21] Appl. No.: 186,839

[22] Filed: Sep. 15, 1980

[51] Int. Cl.[3] ..... E05D 15/40

[52] U.S. Cl. ..... 49/248; 49/249; 49/251

[58] Field of Search ..... 49/248, 250, 251, 252; 16/163

[56] References Cited

U.S. PATENT DOCUMENTS 2,784,459 3/1957 Anderberg et al. ..... 49/250 X 3,197,818 8/1965 Sargent et al. ..... 49/252 X

FOREIGN PATENT DOCUMENTS 15504 of 1929 Australia ..... 49/251

*Primary Examiner*—Kenneth Downey

*Attorney, Agent, or Firm*—Lyon & Lyon

[57] ABSTRACT

An improved linkage mechanism for the opening and closing of a transom-type window, allowing for the window sash to fit tightly within the window frame in a closed position while, on the other hand, allowing for maximum open space for escape through the window frame when the window is opened. A tight fit between the sash and frame of the window is accomplished by having flanges on the sash and linkage means which causes the window sash to be first translated away from the window frame upon opening, providing enough clearance for the window to then be pivoted to an open position on a pivotal axis disposed away from the frame. The linkage is also designed to allow for maximum open space for individuals to escape through the window frame in an open position and a latch mechanism for holding the window in the full-open position for escape.

9 Claims, 7 Drawing Figures

FULL-OPENING WINDOW LINKAGE ASSEMBLY

BACKGROUND

The improved linkage is adapted to be employed for the support of, and for the opening and closing of, casement type or transom type windows permitting pivotal movement of the window sash about a vertical or horizontal axis. The linkage is adapted to be connected between a conventional window frame and a window sash, whether the structures be formed of metal or wood. This type of window frame and sash configuration is illustrated in the Anderberg U.S. Pat. No. 2,784,459 issued Mar. 12, 1957, which is referred to and incorporated herein by reference. Typically, these types of windows include a stationary window frame which is attached to and built into the walls of a building, and a window sash adapted for mating within said frame. Both the sash and frame typically are similar in cross-section and formed from extrusions in the form of "Z" bars having webs with extended inner and outer lips so that when the window sash is fitted within the window frame, the outer lip of the window sash bears against the entire perimeter of the corresponding window frame and the inner lip of the window frame is engaged by the lip of the window sash. The pair window support linkages are mounted in an accommodation space between the sash and the frame with one at the top and one at the bottom in case of a vertically hung window, or one on either side in case of a horizontally hung window. Other patents disclosing windows and supporting brackets of this type are the Anderberg and Taylor U.S. Pat. Nos. 3,345,777 issued Oct. 10, 1967, 4,042,266 issued Aug. 16, 1977, and 3,722,142 issued Mar. 27, 1973, all of which are referred to and incorporated herein by reference. However, while these patents disclose devices which are effective in allowing for the opening and closing of a window sash upon a window frame, they do not provide the advantages of the present invention such as allowing for the maximum open space possible for a given frame dimension for the escape of an individual therethrough in case of a fire. The prior art windows swing to an open position substantially spaced from the edge of the opening which with some arrangement, positions the window near the middle of the window opening thereby blocking escape by a person unless the window is very large.

This problem has been emphasized recently by various building and safety regulations and state laws that require buildings to have escape windows with a sufficient opening it its open position to allow the escape of a human being. Some codes require one such escape window in each bedroom on the first and second floors. Generally, an escape window must provide an opening of at least 21" and it must latch open. Because of the requirements mandated by these regulations, conventional devices, including those described in the prior art have been unsatisfactory.

SUMMARY OF THE INVENTION

The present invention provides a reliable window support mechanism, simple in design, but allowing for both maximum sealing and maximum escape area in its open position, as well as the window to be latched in the open position automatically.

The present invention solves these problems by allowing for as much as a 21 inch open escape area in a window frame having only a 24 inch opening. In this configuration only about 3 inches of the window opening are blocked by the window assembly by reason of the linkage pivoting and sliding drawings wherein: the window toward one edge of the window frame and opening a full 90°.

DESCRIPTION OF DRAWINGS

These and other features, aspects and advantages of the present invention will be better understood with reference to the following description, pending claims and accompanying drawings wherein:

The present invention is directed to an improved linkage system for a window frame assembly which is particularly useful for allowing the maximum escape space and latching in the open position for escape purposes but the linkage is equally useful in for other conventional applications. For purposes of this application, the linkage will be described in connection with a transom type window that pivots on a horizontal axis although it is to be understood it can be used on windows that pivot on a vertical axis.

Figure 1:
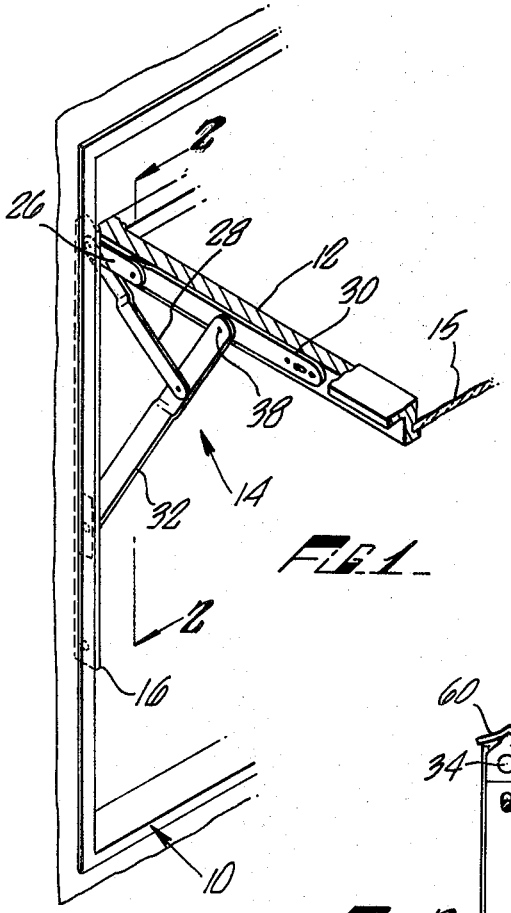
FIG. 1 shows a perspective view of the window assembly showing the fixed window frame, the moveable window sash in the open position and the linkage assembly allowing the window sash to be opened or closed in relation to the window frame.

With reference to FIG. 1, there is shown, in perspective, window frame 10 which is typically placed in the wall or frame of a building. Window sash 12, which fits within the frame 10 of the window when the window is closed, is supported in relation to window frame 10 by means of the improved linkage assembly generally referred to by the number 14. A pane of glass 15 is attached to and framed by window sash 12. The window sash can then be moved to an open or closed position by movement defined by the interaction of the members of the linkage means 14.

Each window is typically supported by two pairs of linkages, each of which includes a track member 16 which is secured by screws 17 to the window frame 10, with one end of the track member adjacent a corner of the window frame.

Mounted on the track member 16 is a slide 18 having side flanges which fit under and are retained by the side flanges 20 of the track member 16. The slide is provided with a cavity within which is a friction shoe backed by a leaf spring as shown in U.S. Pat. No. 2,784,459. The tension of the leaf spring is controlled by set screw 56 directed through the wall of the slide. Slide 18 is slidable between the lower end of the track member 16 to about the midpoint of the track.

Located at a point on the track member 16 adjacent to the upper corner of the window frame is a raised boss 22 extending to a level flush with the upper surfaces of the side flanges 20. A pivot pin 24 is mounted in boss 22 and pivotally connected to upper linkage means 26 and stabilizing linkage means 28, which form part of the linkage system which regulates the movement of the sash in relation to the window frame. The other linkage members cooperating for this purpose are sash support member 30 and lower linkage 32. Sash support member 30 is secured to the confronting side of the window sash by screws 31 and is in turn pivotally connected to the stationary track support member by upper linkage means 26 and lower linkage means 32. The upper linkage means 26 is connected at one end to track member 16 by pivot pin 24 and at the other end to member 30 by pivot pin 34. Offset 36 is provided on sash support member 30 to allow the sash support member to clear pivot pin 24 and linkage 28 when the linkage is in a collapsed position.

Figure 2:
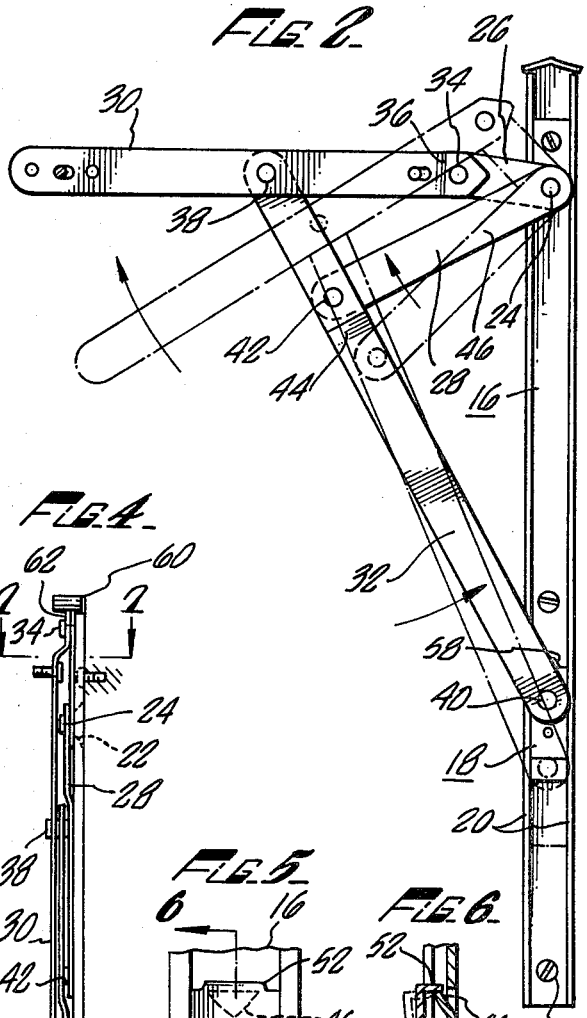
FIG. 2 is a side view illustrating the operation of the linkage, the solid lines showing the linkage extended to its maximum open position, the dotted lines indicating the mechanism in a partially opened position.
Figure 3:
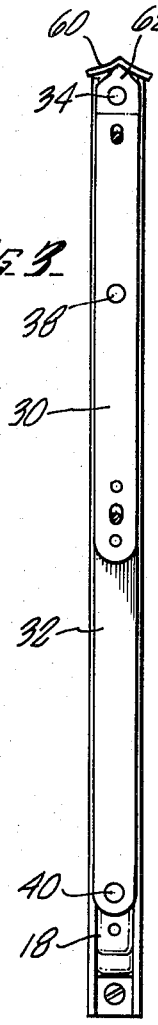
FIG. 3 is a side view of the linkage in FIG. 2 in a collapsed position.
Figure 4:
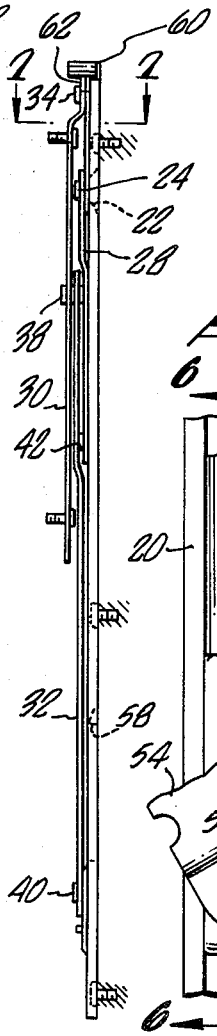
FIG. 4 shows a front view of the linkage in the collapsed position as shown in FIG. 3.
Figure 7:
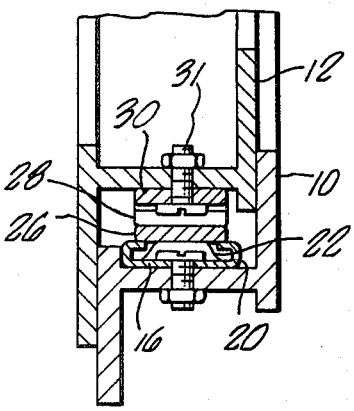
FIG. 7 is a top view, partly in cross section of the relationship of the sash, frame and linkage assembly in the closed position of the window.

The sash support member 30 is also provided with another pivot pin 38 pivotally connecting said member with lower linkage member 32, which is in turn pivotally connected through pivot pin 40 to slide 18. The lower linkage means 32 is in turn stabilized by being connected through pivot pin 42 to stabilizing linkage 28. Lower linkage element 32 as well as stabilizing linkage 28 are provided with offsets 44 and 46 respectively to provide for clearance so that the linkage elements can be superimposed one upon the other in a collapsed position in approximate alignment with track member 16. FIGS. 3, 4 and 7 illustrate the linkages in a collapsed position while FIGS. 1 and 2 illustrate the linkages in a semi-open and open position. When the linkages are in the collapsed position, the length ("a") of the stabilizing linkage 28 between pivot pins 42 and 24 added to the length ("6") of the upper linkage 26 between pivot pins 24 and 3 is equal to the length ("c") of the sash support member 30 between pivot points 34 and 38 and the length ("d") of the lower linkage 32 between pivot pins 38 and 42. (i.e. $a+b=c+d$). However, these lengths and distances are all different in a preselected relationship to thereby cause the desired pivoting and swinging of the window upon opening and closing.

Figure 5:
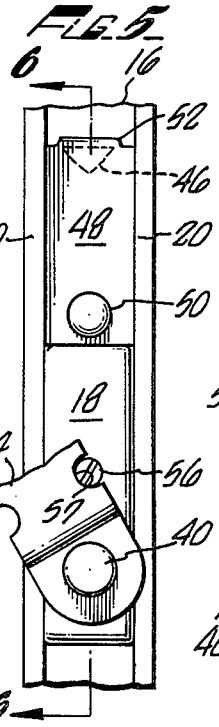
FIG. 5 shows an enlarged from view of the slide member having a latch allowing for the window to be releasably secured in an open position.
Figure 6:
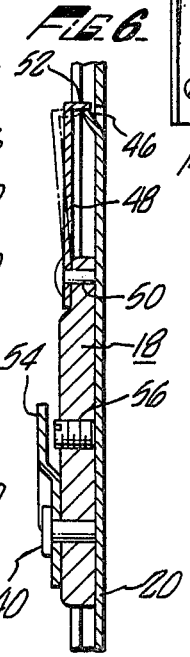
FIG. 6 shows an enlarged sectional view of the slide and latch of FIG. 5.

Turning now to FIGS. 5 and 6, in order to provide a safety latch to retain the sash in an open position, indentation or stop 46 is punched on the track member 16 which is engaged by leaf spring latch 48 attached to the slide 18 by rivet 50.

When the window is pivoted to the full-open position, ridge 52 on leaf spring latch 48 engages the edge of stop 46 thus preventing the window from closing. When sufficient pressure is applied to overcome the grip of leaf spring 48 on stop 46, causing the leaf spring to give and the latch member to disengage, the window may be moved to any other position. The latch apparatus hereinbefore described is optional and may be placed only on the windows which are required to provide the escape hatch in accordance with the previously described ordinances. It is noted that when the latch apparatus is utilized, an offset 54 is provided on lower linkage 32 in order to clear the friction adjustment screw 56 and a notch 57 is provided in offset portion 54 to provide access to screw 56.

When a latch is not utilized, a stop 58 (see FIGS. 2 and 4) is provided on track member 16, similar to stop 46 but facing downward, to define the limit on the upward movement of slide 18 and thus regulate the extent of opening of the window.

Since it is desirable that the window sash fit tightly within the window frame, when the window is closed, track member 16 is provided with cam member 60 which is secured to the upper end of the track adjacent to the corner of the window frame. This cam member, which can be spot welded or otherwise secured to track member 16, is designed to engage the corresponding cam face 62 on the end of sash support member 30 and draw the window sash and window frame tightly together as more fully described in U.S. Pat. No. 2,784,459. Thus, when the window is closed and the sash is drawn tightly to the window frame, the linkage mechanism 14 is collapsed and folds into space 58 between the frame and the sash (FIG. 7). In this regard, it is noted that it is not desirable that the axis of the various pivot pins on the linkage be in strict alignment since the various linkages are intended to occupy the position parallel to but laterally offset from the median line of track member 16 thus enabling the support linkages to be mounted on either end of a window frame and sash without requiring the manufacture of "right" and "left" pairs. By disposing sash support member 30 in a laterally offset position, the various pivotal axis are offset sufficiently that the sash support member moves freely and easily from the parallel superimposed position to its various angular positions.

In moving the window from the closed position to the open position, the linkage 26 initially causes the upper end of the window sash 12 to move outwardly thereby clearing the frame 10 as the window starts to pivot. The slide 18 moves upward in track 16 to allow the window to pivot outwardly and since linkage 26 is very short, the window does not drop downwardly very far in pivoting from the full-closed to full-open position where the window extends a 90° to the frame to provide a completely clear, large opening. During closing, the linkage 26 moves the top of the window inwardly and outwardly, together with the operation of cam 60 and cam face 62, into the closed position.

Thus, in operation, it can be seen that the linkage means 14 enables the sash to be tightly fitted within window frame 10 while at the same time allowing for a maximum opening for exiting through the window. In the actual preferred embodiment, 21 inches of vertical open space can be provided in a 24 inch window frame.

Although the present invention has been described in considerable detail with reference to certain embodiments thereof, other embodiments are possible. Therefore, the spirit and scope of the invention should not necessarily be limited to the description of the embodiments contained herein.

I claim:

1. An improved linkage supporting and positioning a window sash in relation to a window frame, comprising:

a window frame track member which is affixed to said window frame;

a moveable sash support member upon which the window sash is attached;

an upper linkage means having one end pivotally connected to said frame track member and the other end pivotally connected to said sash support member;

a slide, slidably connected to said frame track member;

a lower linkage means having one end pivotally connected to said slide and the other end pivotally connected to said sash support member at a joint removed from the connection of said support member with the upper linkage means;

a stabilizing linkage pivotally connected on one end to the frame track member and on the other end to the lower linkage means; and whereby the window sash affixed to said moveable support member is both translated away from the window frame and pivotally rotated to effectuate the opening and closing of said sash in relation to said window frame allowing for both tight sealing upon closing and a maximum escape opening per length of a window frame, upon opening.

2. The improved linkage of claim 1 wherein a stop is provided on the window frame track member to limit the upward movement of said slide and therefore to limit the opening of said window.

3. The improved linkage in claim 1 wherein said track member is provided with a stop and the slide is provided with a spring bar which engages said stop and locks the window in place in an open position.

4. The improved linkage in claim 1 wherein the upper linkage means is pivotally connected to the track member and is positioned adjacent to the track member and said upper linkage means is pivotally connected to the sash support member with the pivot connection located on the side away from said track member, said sash support member being offset outwardly to clear the pivot point pivotally connecting both the stabilizing linkage and upper linkage to the track member, said sash support member being connected to the lower linkage means, on the inside of said sash support member towards the track member, said lower linkage being pivotally connected on the side towards the track member to the stabilizing linkage, the stabilizing linkage being offset inwardly to clear the pivotal connection between the sash support member and lower linkage.

5. In an improved window assembly having a fixed window frame and a mating moveable window sash which can be opened and closed in relation to said window frame, the improved linkage means for opening said window by translating and rotating said sash away from said window frame, comprising:

a frame track member affixed to the window frame;

a moveable support member for supporting the sash;

said moveable support member being connected to the frame track by an upper and lower linkage means, the upper linkage being pivotally connected between the upper portion of the frame track member and the top portion of said moveable support member, and the lower linkage means having one end pivotally connected to the moveable support member and the other member slidably connected to said frame track member;

a stabilizing member, one end of which is pivotally connected to the track member and the other end pivotally connected to the lower linkage; and whereby the linkage means allows the moveable sash to both translate and rotate away from said stationary window frame providing, on one hand, firm sealing in the closed position and, on the other hand, the maximum open space possible for escape in the open position.

6. The improved linkage in claim 5 wherein a stop is provided on the window frame track member to limit the upward movement of said slide and therefore to limit the opening of said window.

7. The improved linkage in claim 5 wherein said track member is provided with a stop and the slide is provided with a spring bar which engages said stop and locks the window in place in an open position.

8. The improved linkage in claim 5 wherein the upper linkage is very short.

9. The improved linkage in claim 5 wherein the upper linkage is very short but of sufficient length to allow the window sash to just clear the outside of the window frame as the link rotates between a position adjacent to the track member, to a position perpendicular to said track member.

* * * * *